US009090053B1

(12) United States Patent
Franke

(10) Patent No.: US 9,090,053 B1
(45) Date of Patent: Jul. 28, 2015

(54) AIR DISPENSER FOR PRINTING PRESS

(76) Inventor: Bruce A. Franke, Plato, MN (US)

( * ) Notice: Subject to any disclaimer, the term of this patent is extended or adjusted under 35 U.S.C. 154(b) by 789 days.

(21) Appl. No.: 12/660,684

(22) Filed: Mar. 2, 2010

Related U.S. Application Data

(60) Provisional application No. 61/209,089, filed on Mar. 3, 2009.

(51) Int. Cl.

| | |
|---|---|
| ***B41F 13/24*** | (2006.01) |
| ***B41F 1/32*** | (2006.01) |
| ***B65H 1/16*** | (2006.01) |
| ***B65H 9/10*** | (2006.01) |
| ***B65H 29/24*** | (2006.01) |

(52) U.S. Cl.
CPC .. *B41F 1/32* (2013.01); *B65H 1/16* (2013.01); *B65H 9/108* (2013.01); *B65H 29/245* (2013.01); *B65H 2406/122* (2013.01)

(58) Field of Classification Search
CPC ..... B41F 1/32; B65H 1/16; B65H 3/14; B65H 3/48; B65H 5/228; B65H 9/108; B65H 29/245–29/248; B65H 2301/4661; B65H 2406/112; B05B 1/14; B05B 1/20; B05B 1/18; B05B 15/065; B05B 1/3006; F23D 14/58
USPC ..... 101/230, 232, 407.1, 408, 409; 239/548, 556, 565, 566
See application file for complete search history.

(56) References Cited

U.S. PATENT DOCUMENTS

| | | | | |
|---|---|---|---|---|
| 2,204,802 | A | 6/1940 | Gessler | 19/59 |
| 2,764,177 | A * | 9/1956 | Paasche | 137/209 |
| 3,559,860 | A * | 2/1971 | East et al. | 226/97.4 |
| 4,705,199 | A * | 11/1987 | Herman et al. | 226/95 |
| 5,787,810 | A * | 8/1998 | Stephan | 101/232 |
| 5,791,247 | A | 8/1998 | Kolb | 101/232 |
| 6,182,677 | B1 * | 2/2001 | Pignataro | 137/15.05 |
| 6,254,094 | B1 * | 7/2001 | Becker et al. | 271/309 |
| 6,619,201 | B1 * | 9/2003 | Becker et al. | 101/230 |
| 6,899,327 | B2 * | 5/2005 | Shimizu et al. | 271/276 |
| 8,139,973 | B2 * | 3/2012 | Ishikawa et al. | 399/92 |
| 2001/0050012 | A1 * | 12/2001 | Koch | 101/232 |
| 2010/0230893 | A1 * | 9/2010 | Ohrui et al. | 271/264 |

* cited by examiner

*Primary Examiner* — Blake A Tankersley
*Assistant Examiner* — Marissa Ferguson Samreth
(74) *Attorney, Agent, or Firm* — Richard John Bartz

(57) ABSTRACT

An air dispenser attached to a printing press has a tube with a plurality of holes for directing air toward sheet material moving toward the gripper of the printing press to ensure registration and accurate feeding of the sheet material to the gripper of the printing press.

14 Claims, 2 Drawing Sheets

AIR DISPENSER FOR PRINTING PRESS

CROSS REFERENCE TO RELATED APPLICATION

This application claims the priority benefit of U.S. Application Ser. No. 61/209,089 filed Mar. 3, 2009.

FIELD OF THE INVENTION

The invention is the art of printing presses and particularly to controls for directing sheets of paper to paper feed mechanisms to ensure proper registration and feeding of the sheets of paper.

BACKGROUND OF THE INVENTION

Printing presses are equipped with feed drum grippers that direct sheets of paper to paper feed cylinders prior to printing on the sheets of paper. Some paper stock has a curl on the leading edges of the paper. The curled paper has a tendency to move away from the feed drum gripper. This causes paper misfeed and improper paper feeding and registration.

Printing presses have been provided with air strippers to aid in separating and peeling the printed material from the blankets to reduce smashed blankets, jam ups of the printing press and resultant down time. The strippers comprise elongated tubes supporting a plurality of nozzles that direct streams of air toward the tops of the printed materials moving from the printing press to peel the printed materials from the blankets. An air pressure regulator adjusts the flow of air into the tube and air discharged by the nozzles. An example of an air stripper for a printing press is disclosed by Daniel L. Kolb in U.S. Pat. No. 5,791,247.

SUMMARY OF THE INVENTION

The air dispenser of the invention is used on a printing press to ensure true feeding of sheets of paper into the feed drum gripper to maintain proper registration and accurate paper feeding every time the sheets of paper enter the gripper. The air dispenser has an elongated tube with longitudinal aligned holes that are laterally spaced from each other. Air under pressure from the air/vacuum pump of the printing press supplies air into the interior passage of the tube. The air flows out the holes as air jets or streams onto the leading edges of the sheets of paper as they enter the feed drum gripper. An air flow regulator coupled to the pump is used to control the rate of air flow discharged through the holes in the tube toward the sheets of paper.

DESCRIPTION OF THE INVENTION

Figure 1:
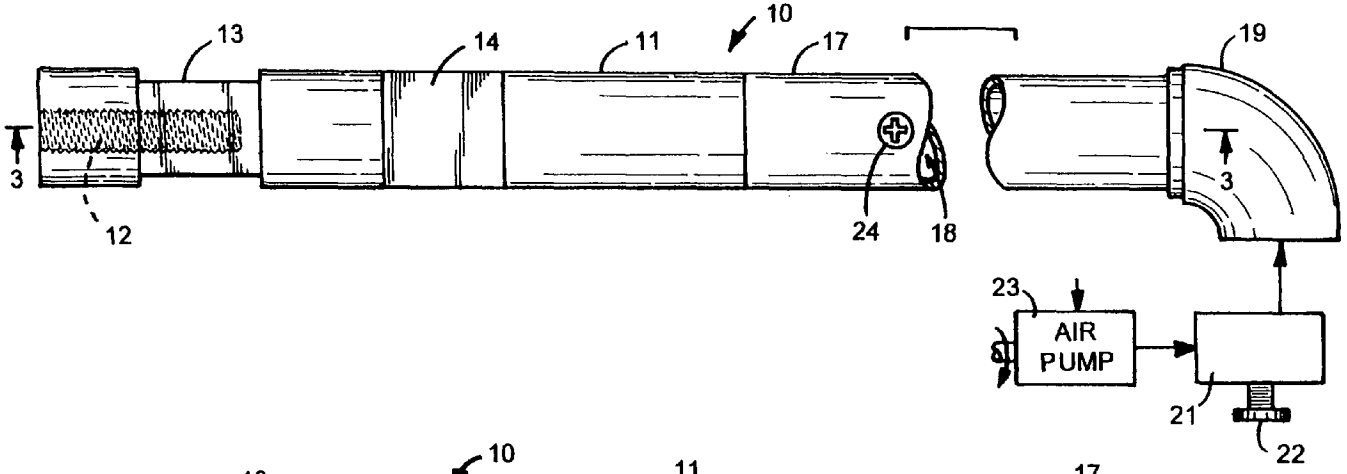
FIG. 1 is a foreshortened top plan view of the air dispenser for a printing press.
Figure 2:
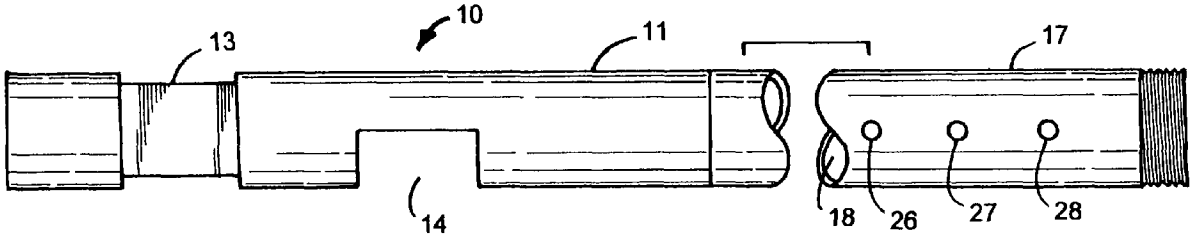
FIG. 2 is a foreshortened side view of the right side thereof.
Figure 3:
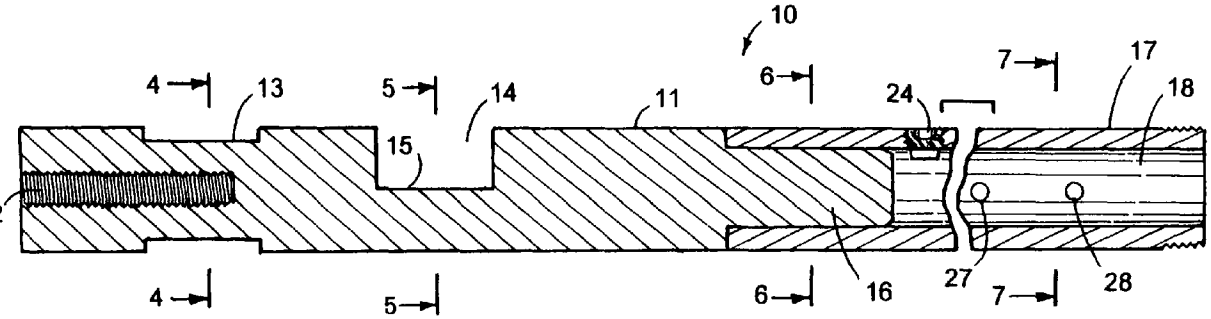
FIG. 3 is a foreshortened sectional view taken along the line 3-3 of FIG. 1.

An air dispenser 10, shown in FIGS. 1 to 3, is used with a printing press to direct sheet material, such as a sheet of paper, to the printing press feed drum gripper. The air dispenser directs one or more streams of air toward the lead edge of the sheet of paper as it moves toward the gripper and to the paper feed cylinder. This ensures proper registration and accurate feeding of the sheet of paper. Examples of printing presses that can accommodate air dispenser 10 are Ryobi 3302 and Ryobi 3303 printing presses. Other types of printing presses can be equipped with air dispenser 10 to ensure feeding of sheets of paper to the printing mechanism.

Figure 4:
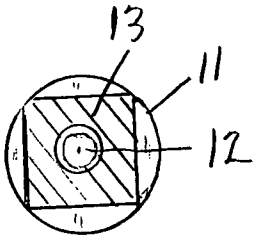
FIG. 4 is a sectional view taken along the line 4-4 of FIG. 3.
Figure 5:
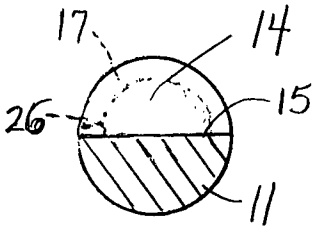
FIG. 5 is a sectional view taken along the line 5-5 of FIG. 3.

Air dispenser 10 has a one-piece metal cylindrical body 11 having an axial threaded hole 12 at the outer end thereof. As shown in FIGS. 3 and 4, a square neck 13 is spaced inwardly from the outer end of body 11. Neck 13 accommodates a hand tool, such as a wrench, used to rotate and position dispenser 10 on a frame of a printing press. A bolt (not shown) threaded into hole 12 secures body 11 to a frame of the printing press. Located inwardly from neck 13 is a notch or cut out 14 having a flat base 15. Base 15 extends across the diameter of body 11 along the longitudinal center plane of body 11. The inner end of body 11 has a cylindrical boss 16 having a diameter smaller that the outside diameter of body 11.

Figure 6:
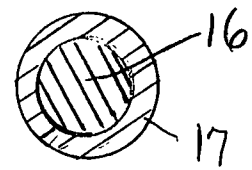
FIG. 6 is a sectional view taken along the line 6-6 of FIG. 3.
Figure 7:
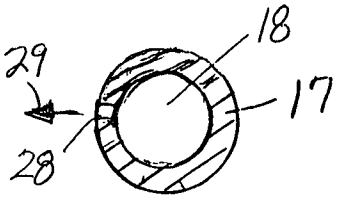
FIG. 7 is a sectional view taken along the line 7-7 of FIG. 3.

As shown in FIGS. 3 and 6, a cylindrical metal tube 17 is telescoped over boss 16 to join tube 17 to body 11. Tube 17 has a tight press fit on boss 16. The outside diameter of tube 17 is co-extensive with the outside diameter of body 11. The inside of tube 17 has a linear air passage 18 open to an elbow 19. Elbow 19 is threaded onto the open end of tube 17. The printing press air/vacuum pump 23 is used to supply air under pressure to an air flow regulator 21 connected to elbow 19 to allow air to flow from regulator 21 into air passage 18 of tube 17. Air flow regulator 21 has a manual control knob 22 operable to regulate the rate of flow of air into air passage 18. A plug or set screw 24 threaded into a hole in tube 17 adjacent boss 16 is removable from tube 17 to allow air under pressure to flow through passage 18 to remove particulates and other materials from passage 18. The air flowing through passage 18 cleans the inside of tube 17 and holes 26 to 28. A plurality of longitudinally spaced small circular holes 26, 27 and 28 in the side of tube 17 allow jets or streams of flowing air to be directed away from tube 17. The number of holes can vary. In one example seven holes are spaced one and one half inches along the length of tube 17. The holes can be longitudinal slots or openings laterally spaced from each other along the length of tube 17. As seen in FIGS. 2, 3, 5 and 7, holes 26 to 28 are located in the horizontal plane of flat base 15 of notch 14. Holes 26 to 28 are laterally spaced along the length of tube 17. The air in passage 18 is discharged through holes 26 to 28 in an outward direction, as shown by arrow 29 in FIG. 7, to the leading end of a sheet of paper moving toward the gripper of a printing press. The flowing air prevents the sheet of paper from curling up away from the gripper. The air dispenser 10 ensures proper registration and accurate feeding of the sheet of paper to the printing press feed drum gripper.

Advantages of Air Dispenser for Printing Press

1. Extend operating life of printing press feed roller;
2. The leading edges of the sheets of paper enter feed drum gripper in proper time sequence;
3. Better registration and constant sheets of paper feeding;
4. Elimination of paper misfeeds;
5. Cuts down on blanket costs due to paper misfeeds and down time;
6. Short run grain paper can be printed;
7. Less powder build up on second pass;
8. Can use infrared heaters with curl sheets of paper; and
9. Increased production after set up.

There has been shown and described one embodiment of the air dispenser for a printing press of the invention. Changes in the structure, materials and arrangement of parts can be made by persons skilled in the art without departing from the invention.

The invention claimed is:

1. An air dispenser for a printing press operable to ensure feeding of sheets of paper to the printing press comprising:

a cylindrical body having an longitudinal axis and a threaded hole in one end of the cylindrical body extended along the longitudinal axis of the cylindrical body adapted to a fastener to connect the cylindrical body to the printing press;

said cylindrical body having a square neck spaced inwardly from said one end of the cylindrical body and extended along the longitudinal axis of the cylindrical body;

said cylindrical body further including a cut out having a flat base located in a horizontal plane extended across the diameter of the cylindrical body along the longitudinal axis of the cylindrical body;

said cylindrical body having a cylindrical boss at an end of the cylindrical body opposite the one end of the cylindrical body extended along the longitudinal axis of the cylindrical body;

an elongated tube have a longitudinal passage and an end section telescoped over the cylindrical boss to close one end of the passage and connect the elongated tube to the cylindrical body;

said elongated tube having a plurality of laterally spaced openings open to the passage of the elongated tube to allow laterally spaced streams of air to flow toward the printing press;

an air pump operable to supply air under pressure to the longitudinal passage of the elongated tube; and an air flow regulator connected to the air pump and elongated tube operable to regulate the rate of the flow of air into the longitudinal passage of the elongated tube and the flow of air discharged from the openings to the printing press.

2. The air dispenser of claim 1 wherein:

the laterally spaced openings in the elongated tube are a plurality of laterally spaced cylindrical holes.

3. The air dispenser of claim 1 including:

an elbow connected to the elongated tube and air flow regulator to direct air from the air flow regulator into the passage of the elongated tube.

4. The air dispenser of claim 1 including:

a hole in the elongated tube open to the longitudinal passage; and a plug in the hole to close said hole, said plug being removable from said hole to allow air to flow through the hole and longitudinal passage of the elongated tube to clean said passage of the elongated tube.

5. The air dispenser of claim 4 wherein:

the plug is a set screw threaded into said hole.

6. The air dispenser of claim 1 wherein:

the air flow regulator includes a manual control knob operable to adjust the rate of flow of air into the longitudinal passage of the elongated tube and air discharged through the laterally spaced openings to the printing press.

7. The air dispenser of claim 1 wherein:

the laterally spaced openings are located in the horizontal plane of the flat base of the cylindrical body.

8. An air dispenser for a printing press operable to ensure feeding of sheets of paper to the printing press comprising:

a cylindrical body having a longitudinal axis and a threaded hole at one end of the cylindrical body extended along the longitudinal axis of the cylindrical body adapted to be connected to the printing press;

said cylindrical body having a square neck spaced inwardly from said one end of the cylindrical body and extended along the longitudinal axis of the cylindrical body;

said cylindrical body further including a cut out spaced from the square neck, said cut out having a flat base located in a horizontal plane extended across the diameter of the cylindrical body along the longitudinal axis of the cylindrical body;

said cylindrical body having a cylindrical boss at an end of the body opposite the one end of the cylindrical body extended along the longitudinal axis of the cylindrical body;

an elongated tube have a longitudinal passage and an end section telescoped over the cylindrical boss to close one end of the passage and connect the elongated tube to the cylindrical body;

said elongated tube having a plurality of laterally spaced openings open to the passage of the elongated tube to allow laterally spaced streams of air to flow toward the printing press;

a hole in the elongated tube open to the passage located between the cylindrical boss of the cylindrical body and the laterally spaced openings in the elongated tube, and a plug located in the hole in the elongated tube, said plug being removable from said hole in the elongated tube to allow air to flow through the hole and the passage of the elongated tube to clean the passage of the elongated tube.

9. The air dispenser of claim 8 wherein:

the laterally spaced openings in the elongated tube are a plurality of laterally spaced cylindrical holes.

10. The air dispenser of claim 8 including:

an elbow connected to the elongated tube and air flow regulator to direct air from the air flow regulator into the passage of the elongated tube.

11. The air dispenser of claim 8 wherein:

the laterally spaced openings are located in the horizontal plane of the flat base of the cylindrical body.

12. The air dispenser of claim 8 including:

an air pump operable to supply air under pressure to the longitudinal passage of the elongated tube; and an air flow regulator connected to the air pump and elongated tube operable to regulate the rate of the flow of air into the longitudinal passage of the elongated tube and the flow of air discharged from the laterally spaced openings to the printing press.

13. The air dispenser of claim 12 wherein:

the air flow regulator includes a manual control knob operable to adjust the rate of flow of air into the longitudinal passage of the elongated tube and air discharged through the laterally spaced openings to the printing press.

14. The air dispenser of claim 8 wherein:

the plug is a set screw threaded into said hole.

* * * * *